United States Patent [19]

Koog

[11] Patent Number: 4,474,584

[45] **Date of Patent: * Oct. 2, 1984**

[54] METHOD OF COOLING AND DEASHING

[75] Inventor: Wolfgang Koog, Pleasantville, N.Y.

[73] Assignee: Texaco Development Corporation, White Plains, N.Y.

[ * ] Notice: The portion of the term of this patent subsequent to Aug. 21, 2001 has been disclaimed.

[21] Appl. No.: 500,492

[22] Filed: Jun. 2, 1983

[51] Int. Cl.[3] ..... C10J 3/46

[52] U.S. Cl. ..... 48/197 R; 48/206; 48/DIG. 2; 55/85; 55/94; 55/95; 252/373

[58] Field of Search ..... 55/85, 93, 94, 95, 223; 48/197 R, 206, DIG. 2; 252/373

[56] References Cited

U.S. PATENT DOCUMENTS 2,931,715 4/1960 Eastman ..... 48/206

2,971,830 2/1961 Kawai et al. ..... 48/206

4,074,981 2/1978 Slater ..... 48/206

4,218,423 8/1980 Robin et al. ..... 48/DIG. 2

*Primary Examiner*—Peter F. Kratz

*Attorney, Agent, or Firm*—Robert A. Kulason; Robert Knox, Jr.; Carl G. Seutter

[57] ABSTRACT

Hot synthesis gas is cooled and deashed by passage through first zone in contact with a downwardly descending film of cooling liquid, a second zone in contact with a spray of cooling liquid, a third zone in contact with a body of cooling liquid, and a fourth zone in contact with a spray of cooling liquid—at least a portion of the cooling liquid to the first zone preferably being recycled cooling liquid from which at least a portion of the solids contained therein has been removed.

8 Claims, 2 Drawing Figures

METHOD OF COOLING AND DEASHING

FIELD OF THE INVENTION

This invention relates to a cooling apparatus. More particularly it relates to a method for cooling a hot synthesis gas under conditions to remove solids therefrom and to thereby prevent their deposition on pieces of equipment during further processing.

BACKGROUND OF THE INVENTION

As is well known to those skilled in the art, it is difficult to satisfactorily cool hot gases, typically at temperatures as high as 1200° F. or higher and particularly so when these gases contain particulates including ash and char. Typical of such gases may be a synthesis gas prepared as by incomplete combustion of a liquid or gaseous hydrocarbon charge or a solid carbonaceous charge. The principal desired gas phase components of such a mixture may include carbon monoxide and hydrogen; and other gas phase components may be present including nitrogen, carbon dioxide, and inert gases. The synthesis gas so prepared is commonly found to include non-gaseous (usually solid) components including those identified as ash, which is predominantly inorganic, and char which is predominantly organic in nature and includes carbon.

A particularly severe problem arises if the solids content of the gas is not lowered. Synthesis gases as produced may (depending on the charge from which they are prepared) typically contain 4 pounds of solids per 1000 cubic feed (NTP) of dry gas. These solids may deposit and plug the apparatus if they are not removed.

It has heretofore been found to be difficult to remove small particles of solids including ash, slag, and/or char from synthesis gases. These particles, typically of particle size of as small as 5 microns or less have been found to agglomerate (in the presence of water-soluble components which serve as an interparticle binder) into agglomerates which may typically contain about 1 w % of these water-soluble components. These agglomerates deposit at random locations in the apparatus typified by narrow openings in or leading to narrow conduits, exits, etc., and unless some corrective action is taken to prevent build-up, may plug the apparatus to a point at which it is necessary to shut down after an undesirably short operation period.

It is an object of this invention to provide a process and apparatus for cooling hot gases and for minimizing plugging of lines. Other objects will be apparent to those skilled in the art.

STATEMENT OF THE INVENTION

In accordance with certain of its aspects, this invention is directed to the method of cooling a hot synthesis gas which comprises passing hot synthesis gas at initial temperature downwardly through a first contacting zone;

passing cooling liquid downwardly as a film on the walls of said first contacting zone and in contact with said downward descending synthesis gas thereby cooling said synthesis gas and forming a cooled synthesis gas;

passing said cooled synthesis gas downwardly through a second contacting zone in contact with a downwardly descending film on the walls of said second contacting zone;

spraying cooling liquid into said downwardly descending cooled synthesis gas in said second contacting zone thereby forming a downwardly descending further cooled synthesis gas;

passing said further cooled synthesis gas into a body of cooling liquid in a third contacting zone thereby forming a further cooled synthesis gas containing a decreased solids content;

passing said further cooled synthesis gas containing a decreased solids content into contact with a sprayed stream of cooling liquid in a fourth contacting zone thereby forming a cooled product synthesis gas; and recovering said cooled product synthesis gas.

DESCRIPTION OF THE INVENTION

The hot synthesis gas which may be charged to the process of this invention may be a synthesis gas prepared by the gasification of coal. In the typical coal gasification process, the charge coal which has been finely ground typically to an average particle size of 20–500 microns preferably 30–300, say 200 microns, may be slurried with an aqueous medium, typically water, to form a slurry containing 40–80 w %, preferably 50–75 w %, say 60 w % solids. The aqueous slurry may then be admitted to a combustion chamber wherein it is contacted with oxygen containing gas, typically air or oxygen, to effect incomplete combustion. The atomic ratio of oxygen to carbon in the system may be 0.7–1.2:1, say 0.9:1. Typically reaction is carried out at 1800° F.–3500° F., say 2500° F. and pressure of 100–1500 psig, preferably 500–1200, say 900 psig.

The synthesis gas may alternatively be prepared by the incomplete combustion of a hydrocarbon gas typified by methane, ethane, propane, etc including mixtures of light hydrocarbon stocks or of a liquid hydrocarbon such as a residual fuel oil, asphalts, or as a solid carbonaceous material such as coke from petroleum or from tar sands bitumen, bituminous and sub-bituminous coals, carbonaceous residues from coal hydrogenation processes, etc.

The apparatus which may be used in practice of this invention when a liquid or gas or solid carbonaceous charge is employed may include a gas generator such as is generally set forth in the following patents inter alia:

U.S. Pat. No. 2,818,326—Eastman et al
U.S. Pat. No. 2,896,927—Nagle et al
U.S. Pat. No. 3,998,609—Crouch et al
U.S. Pat. No. 4,218,423—Robin et al Effluent from the reaction zone in which charge is gasified to produce synthesis gas may be 1800° F.–3500° F. preferably 2000° F.–2800° F., say 2500° F. at 100–1500 psig, preferably 500–1200 psig, say 900 psig.

Under these typical conditions of operation, the synthesis gas commonly contains (dry basis) 35–55 v %, say 50 v % carbon monoxide, 30–45 v %, say 38 v % hydrogen; 10–20 v %, say 12 v %, carbon dioxide, 0.3 v %–2 v %, say 0.8 v % hydrogen sulfide; 0.4–0.8 v %, say 0.6 v % nitrogen; and methane in amount less than about 0.1 v %.

When the fuel is a solid carbonaceous material, the product synthesis gas may commonly contain solids (including ash, char, slag, etc) in amount of 1–10 pounds, say 4 pounds per thousand cubic feet (NTP) of dry product gas; and these solids may be present in particle size of less than 1 micron up to 3000 microns. The charge coal may contain ash in amount as little as 0.5 w % or as much as 40 w % or more. This ash is found in the product synthesis gas.

In accordance with practice of this invention, the hot synthesis gases at this initial temperature are passed downwardly through a first contacting zone. The upper extremity of the first contacting zone may be defined by the lower outlet portion of the reaction chamber of the gas generator. The first contacting zone may be generally defined by an upstanding preferably vertical perimeter wall forming an attenuated conduit; and the cross-section of the zone formed by the wall is in the preferred embodiment substantially cylindrical. The outlet or lower end of the attenuated conduit or dip tube at the lower extremity of the preferably cylindrical wall preferably bears a serrated edge.

The first contacting zone is preferably bounded by the upper portion of a vertically extending, cylindrical dip tube which has its axis colinear with respect to the combustion chamber.

At the upper extremity of the first contacting zone in the dip tube, there is mounted a quench ring through which cooling liquid, commonly water is admitted to the first contacting zone. From the quench ring there is directed a first stream of cooling liquid along the inner surface of the dip tube on which it forms a preferably continuous downwardly descending film of cooling liquid which is in contact with the downwardly descending synthesis gas. Inlet temperature of the cooling liquid may be 100° F.–500° F., preferably 300° F.–480° F., say 420° F. The cooling liquid is admitted to the falling film on the wall of the dip tube in amount of 20–70, preferably 30–50, say 45 pounds per thousand cubic feet (NTP) of gas admitted to the first contacting zone. It is a feature of the process of this invention that the cooling liquid admitted to the contacting zones, and particularly that admitted to the quench ring, may include recycled liquids which have been treated to lower the solids content. Preferably those liquids will contain less than about 0.1 w % of solids which have a particle size larger than about 100 microns, this being effected by hydrocloning.

As the falling film of cooling liquid contacts the downwardly descending hot synthesis gas, the temperature of the latter may drop by 200° F.–500° F. preferably 300° F.–400° F., say 350° F. because of contact with the falling film during its passage through the first contacting zone.

The gas may pass through the first contacting zone for 1–8 seconds, preferably 1–5 seconds, say 3 seconds. Gas exiting this first zone may have a reduced solids content.

The cooled synthesis gas which leaves the first contacting zone wherein it is cooled by the falling film of cooling liquid is admitted to a second contacting zone through which it passes as it is further contacted with the downwardly descending film of cooling liquid.

In accordance with practice of the process of this invention, there is also introduced into the second contacting zone, preferably at the upper extremity thereof, a spray of cooling liquid at 100° F.–500° F., say 420° F. This spray is admitted, preferably in a direction normal to the inside surface of the dip tube (i.e. in a direction toward the axis of the dip tube). The intimate contact of the sprayed liquid and the descending synthesis gas as the latter passes through the second contacting zone insures a higher level of heat and mass transfer and resultant cooling of the synthesis gas than is the case if the same total quantity of cooling liquid be passed downwardly as a film on the wall.

The amount of liquid sprayed into the second contacting zone is about 20–80 pounds per hour, preferably 30–60 pounds per hour, say 57 pounds per hour per 1000 cubic feet (NTP) of dry gas passing therethrough. Because of the high degree of contact between gas and liquid, the temperature of the gas may drop by 600° F.–1300° F. preferably 800° F.–1200° F., say 1100° F. during passage through the second zone. Gas leaving the lower end of the second contact zone typically may contain a reduced concentration of solids.

The lower end of the second contacting zone is submerged in a pool of liquid formed by the collected cooling liquid. The liquid level, when considered as a quiescent pool, may typically be maintained at a level such that 10%–80% , say 50% of the second contacting zone is submerged. It will be apparent to those skilled in the art that at the high temperature and high gas velocities encountered in practice, there may of course be no identifiable liquid level during operation—but rather a vigorously agitated body of liquid.

The further cooled synthesis gas leaves the bottom of the second contacting zone at typically 900° F.–1050° F. and it passes through the said body of cooling liquid (which consitutes a third contacting zone) and under the lower typically serrated edge of the dip tube. The solids fall through the body of cooling liquid wherein they are retained and collected and may be drawn off from a lower portion of the body of cooling liquid. Commonly the gas leaving the third contacting zone may have had 75% of the solids removed therefrom. The temperature drop of the gas as it passes through the third contacting zone maybe 200°–650° F., say 350° F.

The further cooled gas at 400° F.–700° F., say 600° F. leaving the body of cooling liquid which constitutes the third contacting zone is preferably passed together with cooling liquid upwardly through a preferably annular passageway through a fourth cooling zone toward the gas outlet of the quench chamber. In one preferred embodiment, the annular passageway is defined by the outside surface of the dip tube forming the first and second cooling zones and the inside surface of the vessel which envelops or surrounds the dip tube and which is characterized by a larger radius than that of the dip tube. Aqueous cooling liquid is sprayed into the upflowing gas as the latter passes upwardly through the fourth cooling zone. Liquid is preferably admitted at 100° F.–500° F., say 420° F. in amount of 20–70, say 40 pounds per 1000 cubic feet (NTP) of dry gas. The gas leaving the third contact zone contains 0.1–3, say 0.6 pounds of solids per 1000 cubic feet (NTP) of dry gas; i.e. typically about 80–90%, say 85 w % of the solids will have been removed.

As the mixture of cooling liquid and further cooled synthesis gas (at inlet temperature of 400° F.–700° F., say 600° F.) passes upwardly through the annular fourth cooling zone, the two phase flow therein effects efficient heat transfer from the hot gas to the cooling liquid: the vigorous agitation in this fourth cooling zone minimizes deposition of the particles on any of the contacted surfaces. Typically the cooled gas exits this annular fourth cooling zone at temperature of 300° F.–520° F., preferably 350° F.–500° F., say 450° F. The gas leaving the fourth contact zone contains 0.1–2.5, say 0.4 pounds of solids per 1000 cubic feet (NTP) of gas; i.e. about 85%–95%, say 90% of the solids will have been removed from the gas.

It is a feature of this invention that the cooled product exiting synthesis gas and cooling liquid are passed (by the velocity head of the stream) toward the exit of the quench tube chamber and thence into the exit conduit which is preferably aligned in a direction radially with respect to the circumference of the shell which encloses the combustion chamber and quench chamber.

In practice of the process of this invention, it is preferred to introduce a directed stream or spray of cooling liquid into the stream of cooled quenched product synthesis gas at the point at which it enters the exit conduit or outlet nozzle and passes from the quench chamber to a venturi scrubber through which the product synthesis gas passes. In the preferred embodiment, this directed stream or spray of cooling liquid is initiated at a point on the axis of the outlet nozzle and it is directed along that axis toward the nozzle and the venturi which is preferably mounted on the same axis.

Although this stream will effect some additional cooling of the product synthesis gas, it is found to be advantageous in that it minimizes, and in preferred operation eliminates, the deposition, in the outlet nozzle and the venturi scrubber, of solids which are derived from the ash and char which originates in the synthesis gas and which may not have been completely removed by the contacting in the several contacting zones.

This last directed stream of liquid at 100° F.–500° F., say 420° F. is preferably admitted in amount of 5–25, say 11 pounds per 1000 cubic feet (NTP) of dry gas.

Cooling liquid may be withdrawn as quench bottoms from the lower portion of the quench chamber; and the withdrawn cooling liquid will contain solidified ash and char in the form of small particles. If desired, additional cooling liquid may be admitted to and/or withdrawn from the body of cooling liquid in the lower portion of the quench chamber.

It will be apparent that this sequence of operations is particularly characterized by the ability to remove a substantial portion of the solid (ash, slag, and char) particles which would otherwise contribute to formation of agglomerates which block and plug the equipment. It will also be found that the several cooling (and washing) operations will cool the solids more efficiently thereby avoiding the vaporization of water from the surface of the particles which are carried along with the gas into the gas exit line. The vaporization of water will result in a concentration of soluble solids contained in the water and may reach super-saturation of these soluble solids which may then undesirably act as a binding promoter. These water soluble solids are leached from the solids into the several water streams.

The several cooling and washing steps insure that the fine particles of ash are wetted by the cooling liquid and thereby removed from the gas.

DESCRIPTION OF PREFERRED EMBODIMENTS

Figure 1:
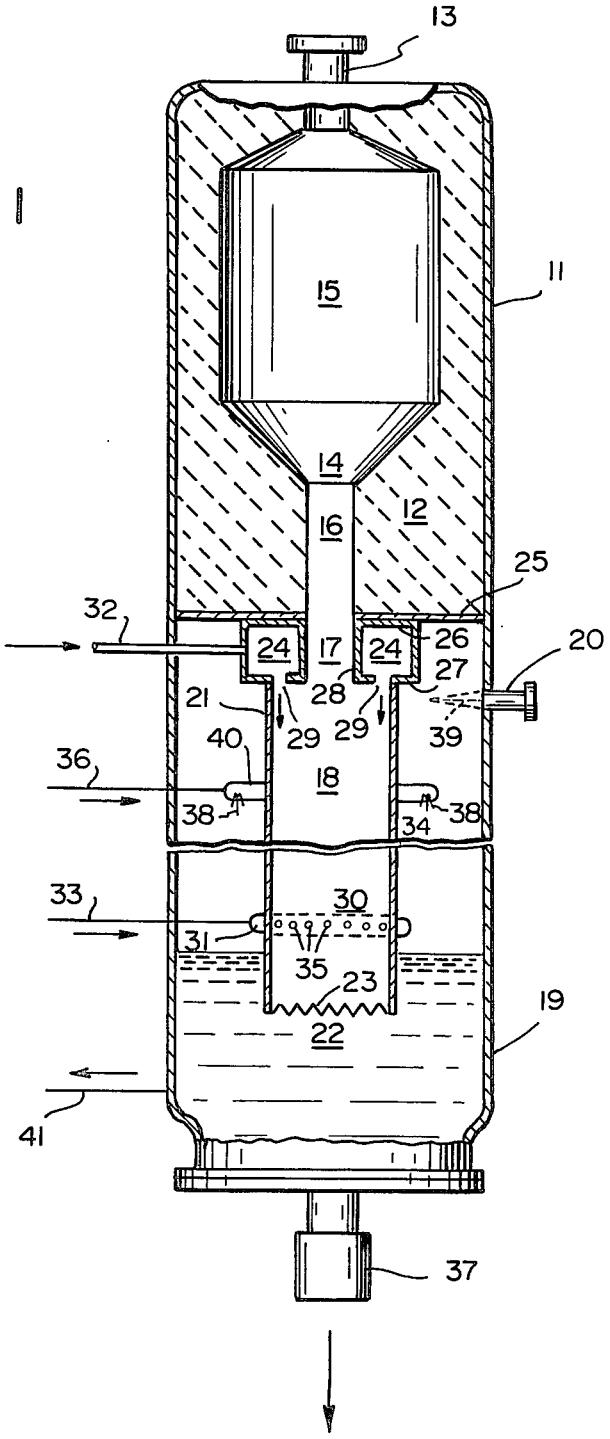
FIG. 1 is a schematic vertical section illustrating a generator and associated therewith a quench chamber.

Practice of this invention will be apparent to those skilled in the art from the following.

EXAMPLE I

In this Example which represents the best mode of practicing the invention known to me at this time, there is provided a reaction vessel 11 having a refractory lining 12 and inlet nozzle 13. The reaction chamber 15 has an outlet portion 14 which includes a narrow throat section 16 which feeds into opening 17. Opening 17 leads into first contacting zone 18 inside of dip tube 21. The lower extremity of dip tube 21, which bears serrations 23, is immersed in bath 22 of quench liquid. The quench chamber 19 includes, preferably at an upper portion thereof, a gas discharge conduit 20.

It is a feature of the invention that there is mounted a quench ring 24 under the floor 25 of the upper portion of the reaction vessel 11. This quench ring may include an upper surface 26 which preferably rests against the lower portion of the floor 25. A lower surface 27 of the quench ring preferably rests against the upper extremity of the dip tube 21. The inner surface 28 of the quench ring may be adjacent to the edge of opening 17. In the preferred embodiment, the quench ring 24 bears inlet nozzle 32.

Quench ring 24 includes outlet nozzles 29 which may be in the form of a series of holes or nozzles around the periphery of quench ring 24—positioned immediately adjacent to the inner surface of dip tube 21. The liquid projected through passageways or nozzles 29 passes in a direction generally parallel to the axis of the dip tube 21 and forms a thin falling film of cooling liquid which descends on the inner surface of dip tube 21. This falling film of cooling liquid forms an outer boundary of the first contacting zone.

At the lower end of the first contacting zone 18, there is a second contacting zone 30 which extends downwardly toward serrations 23 and which is also bounded by the downwardly descending film of cooling liquid on the inside of dip tube 21. Within the boundaries of second contacting zone 30 is spray chamber (or ring) 31 which includes outlet nozzles 35 which may be in the form of a series of holes or nozzles around the periphery of chamber 31. The liquid projected through the schematically represented spray nozzles 35 passes in a direction which preferably has a substantial component toward the axis of the dip tube 21; and in a preferred embodiment, the spray nozzles may be positioned in a circle on the quench ring, around the axis of the dip tube toward which they point. Cooling liquid may be admitted to spray chamber 31 through line 33.

In the second contacting zone characterized by the presence of the spray from spray chamber 31, there is formed a further cooled synthesis gas which is passed downwardly into the third contacting zone generally delineated by the bath 22. The gas passes downwardly past serrations 23 and then upwardly through the body of cooling liquid which comprises the third contacting zone.

At the upper end of the third contacting zone, the further cooled synthesis gas containing a decreased amount of solids is passed into the fourth zone 34.

The fourth contact zone is characterized by the presence of a sprayed stream of cooling liquid admitted through line 36 to spray ring 40 from which the liquid is sprayed through nozzles 38.

The cooled product synthesis gas is passed upwardly and is withdrawn through outlet nozzle 20 from which it is preferably passed through a venturi scrubber for further removal of solids. In this embodiment, there is preferably provided a liquid spray adapted to spray cooling liquid 39 from a point on the axis of gas discharge outlet nozzle 20 along that axis and into the nozzle 20 and the venturi scrubber which is preferably placed proximate thereto. This will minimize deposition of solids at this point in the apparatus.

In operation of the process of this invention utilizing the apparatus of FIG. 1, there are admitted through inlet nozzle 13, a slurry containing 100 parts per unit time (all parts are parts by weight unless otherwise specifically stated) of charge carbonaceous fuel and 60 parts of water which in this embodiment is characterized as follows:

TABLE

| Component | Weight % |
|---|---|
| Carbon | 43.1 |
| Hydrogen | 3.5 |
| Nitrogen | 1.2 |
| Sulfur | 2.4 |
| Oxygen | 3.5 |
| Mineral Matter | 8.8 |
| Water | 37.5 |
| Total | 100 |

There are also admitted 90 parts of oxygen of purity of 99.5 v %. Combustion in chamber 15 raises the temperature to 2500° F. at 900 psig. Product synthesis gas, passed through outlet portion 14 and throat section 16 may contain the following gaseous components:

TABLE

| Component | Volume % | |
|---|---|---|
| | Wet basis | Dry basis |
| CO | 38.6 | 48.5 |
| $H_2O$ | 30.5 | 38 |
| $CO_2$ | 9.6 | 12 |
| $H_2O$ | 20 | — |
| $H_2S$ | 0.8 | 1 |
| $N_2$ | 0.4 | 0.5 |
| $CH_4$ | 0.08 | 0.01 |

This synthesis gas may also contain about 4.1 pounds of solid (char and ash) per 1000 SCF dry gas (NTP).

The product synthesis gas (235 parts) leaving the throat section 16 passes through the opening 17 in the quench ring 24 into first contacting zone 18. Aqueous cooling liquid at 420° F. is admitted through inlet line 34 to quench ring 24 from which it exits through outlet nozzles 29 as a downwardly descending film on the inner surface of dip tube 21 which defines the outer boundary of first contacting zone 18. As synthesis gas, entering the first contacting zone at about 2500° F., passes downwardly through the zone 18 in contact with the falling film of aqueous cooling liquid, it is cooled to about 2150° F.

The so-cooled synthesis gas is then admitted to the second contacting zone 30 which is characterized by the presence of sprayed cooling liquid. Cooling liquid is admitted to the second contacting zone at 420° F. through cooling liquid inlet line 33. This liquid passes to spray channel 31 which is typically in the form of a circumferential distributor ring from which cooling liquid is sprayed through holes in the wall of dip tube 21 into the interior portion thereof which defines the second contacting zone. In this second contacting zone, the cooled synthesis gas is in contact both with the so-sprayed cooling liquor and the falling film; and it is cooled therein to 1100° F.

This further cooled synthesis gas is passed into a body of cooling liquid 22 in a third contacting zone. Although the drawing shows a static representation having a delineated "water-line", it will be apparent that in operation, the gas and the liquid will be in violent turbulence as the gas passes downwardly through the body of liquid, leaves the dip tube 21 passing serrated edge 23 thereof, and passes upwardly through the body of liquid outside the dip tube 21.

The further cooled synthesis gas, during its contact with cooling liquids has lost at least a portion of its solids content. Typically the further cooled synthesis gas containing a decreased content of ash particles (at 600° F.) contains solids (including ash and char) in amount of about 0.6 pounds per 1000 SCF dry gas (NTP).

The further cooled synthesis gas containing a decreased content of solid particles is passed into a fourth cooling or contacting zone wherein the gas (at 600° F.) is contacted with a spray of cooling liquid at 420° F. The cooling liquid (40 pounds per 1000 SCF of dry gas, NTP) is admitted through cooling liquid inlet 36 to spray ring 40 from which it is sprayed through nozzles 38 into fourth contacting zone 34. The cooled product synthesis gas exits the fourth contact zone at about 460° F.

Cooling water may be drawn off through line 41 and solids collected may be withdrawn through line 37.

The exiting gas is withdrawn from the cooling system through gas discharge conduit 20 and it commonly passes through venturi thereafter wherein it may be mixed with further cooling liquid for additional cooling and/or loading with water. This venturi is preferably immediately adjacent to the outlet nozzle.

In the preferred embodiment, there is admitted a spray 39 of aqueous cooling liquid into the cooled product synthesis gas and preferably this spray is directed along the axis of the gas discharge conduit and into the conduit. This tends to minimize or eliminate deposition of solid particles in the conduit and in the venturi immediately adjacent thereto.

EXAMPLE II

Figure 2:
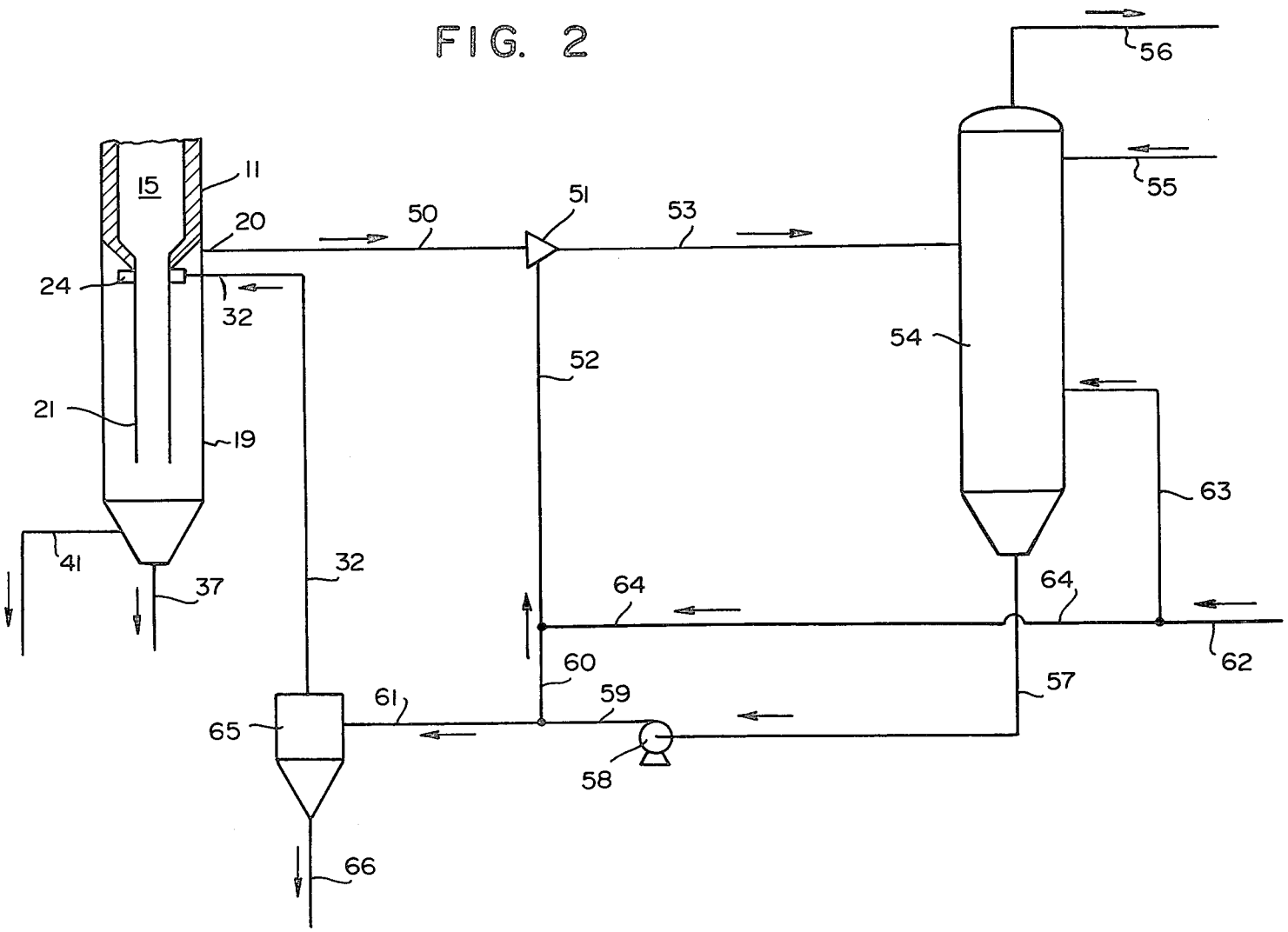
FIG. 2 is a schematic flow sheet showing a process flow plan of a preferred embodiment of one aspect of the process of this invention.

In FIG. 2, there is set forth a process flow sheet embodying the apparatus of FIG. 1 together with associated apparatus which may be present in the preferred embodiment.

Synthesis gas (235 parts), generated and treated as in Example I, leaves quench chamber 19 through gas discharge conduit (outlet nozzle) 20 at 460° F. and 900 psig. This stream, containing solids (ash plus char) in amount of 0.4 pounds per 1000 SCF (NTP) of dry gas is passed through line 50 to venturi mixer 51 wherein it is contacted with 90 parts (per 1000 SCF dry gas) of aqueous cooling liquid at 430° F. from line 52.

The stream (at 450° F.) in line 53 is passed to scrubbing operation 54 wherein it is contacted with 15.3 parts of aqueous scrubbing liquid per 1000 SCF dry gas admitted through line 55. As synthesis gas from line 53 passes upwardly through scrubbing operation 54, which may contain packing, trays, or spray nozzles, the solids content is decreased from an initial value of 0.4 pounds per 1000 SCF of dry gas and the temperature decreases to 445° F. at 885 psig, at which conditions, the synthesis gas is withdrawn through line 56.

Aqueous scrubbing liquid (200 parts per 1000 SCF dry gas) at 445° F. leaves scrubber 54 through line 57 and it is passed through pump 58 and line 59. A portion thereof (ca 15 w %) is recycled through line 60 and 52 to venturi 51. Make-up aqueous liquid may be admitted to the system as needed through lines 62, 63, and 64.

It is a feature of the process of this invention in its preferred aspects, that the stream of recirculating aqueous liquid in line 61, which is to pass to line 32 and thence to the quench ring 24, be treated to lower the content of solids therein. Typically the stream in line 61 will contain as much as 18 pounds of solids (ash and char) per 100 cubic feet of liquid; and it is found that these solids may be of particle size as large as 100 microns or larger. Commonly the stream in line 61 may contain say 10 pounds of solids per 100 cubic feet of liquid and these solids may range in size from micron size of 1–5 microns up to 200–500 microns. The stream in line 61 is treated to separate the larger size particles; and preferably to remove particles of size larger then about 15 microns. In the preferred mode of operation, the stream 61 is treated so that at least 80 w % of the particles remaining therein are of particle size less than about 10 microns. The stream in line 32 contains as little as 0.03 w % solids.

Although this may be effected in a filter, by passage through a bed of sand, or by decanting from a settling vessel, it is preferably effective in a hydroclone 65 from which there is removed an ash-rich stream through line 66.

When operating in this preferred mode, it is observed that the outlet perforations in the quench ring remain free of deposits for an extended period of time.

Although this invention has been illustrated by reference to specific embodiments, it will be apparent to those skilled in the art that various changes and modifications may be made which clearly fall within the scope of this invention.

I claim:

1. The method of cooling a hot synthesis gas which comprises passing hot synthesis gas at initial temperature downwardly through a first contacting zone in a quench chamber;

passing cooling liquid downwardly as a film on the walls of said first contacting zone and a contact with said downwardly descending synthesis gas thereby cooling said synthesis gas and forming a cooled synthesis gas;

passing said cooled synthesis gas downwardly through a second contacting zone in said quench chamber in contact with a downwardly descending film on the walls of said second contacting zone;

spraying cooling liquid into said downwardly descending cooled synthesis gas in said second contacting zone thereby forming a downwardly descending further cooled synthesis gas;

passing said further cooled synthesis gas into a body of cooling liquid in a third contacting zone in said quench chamber thereby forming a further cooled synthesis gas containing a decreased solids content;

passing said further cooled synthesis gas containing a decreased solids content into contact with a sprayed stream of cooling liquid in a fourth contacting zone in said quench chamber thereby forming a cooled product synthesis gas; and recovering said cooled product synthesis gas.

2. The method of cooling a hot synthesis gas as claimed in claim 1 wherein said hot synthesis gas is at temperature of 1800° F.–3500° F. and contains solids in amount of 1–10 pounds per thousand cubic feet (NTP) of dry gas.

3. The method of cooling a hot synthesis gas as claimed in claim 1 wherein said cooling liquid is at inlet temperature of 100° F.–500° F.

4. The method of cooling a hot synthesis gas as claimed in claim 1 wherein said gas is cooled by 200° F.–500° F. during passage through said first contacting zone.

5. The method of cooling a hot synthesis gas as claimed in claim 1 wherein said gas is cooled by 600°–1300° F. during passage through said second contacting zone.

6. The method of cooling a hot synthesis gas as claimed in claim 1 wherein said gas is cooled by 200°–650° F. during passage through said third contacting zone.

7. The method of cooling a hot synthesis gas as claimed in claim 1 wherein said gas leaving said third contacting zone contains about 10–20 w % of the solids in the hot synthesis gas.

8. The method of cooling from an initial high temperature of 1800°–3500° F. to a lower final temperature of about 400°–700° F., a hot synthesis gas containing solid particles including ash and char which comprises passing hot synthesis gas containing ash and char at initial hot temperature downwardly through a first contacting zone in a quench chamber;

passing cooling liquid, containing less than about 0.1 w % of solid particles having a particle size larger than about 100 microns, into said first contacting zone;

passing said hot synthesis gas through said first contacting zone in the presence of a falling film of cooling liquid passing downwardly on the walls of said contacting zone thereby forming a cooled synthesis gas;

passing said cooled synthesis gas downwardly through a second contacting zone in said quench chamber in contact with a downwardly descending film on the walls of said second contacting zone;

spraying cooling liquid into said downwardly descending cooled synthesis gas in said second contacting zone thereby forming a further cooled synthesis gas containing a decreased solids content;

passing said cooled synthesis gas into contact with a body of cooling liquid in said quench chamber thereby forming a cooled product synthesis gas containing a decreased content of solid particles; then contacting said cooled product synthesis gas with a spray of aqueous scrubbing liquid in said quench chamber thereby forming a product synthesis gas substantially free of solids and a scrubber liquid effluent containing solid particles;

separating at least a portion of said solid particles from at least a portion of said scrubber liquid effluent containing solid particles thereby forming a liquid containing less than about 0.1 w % of solid particles having a particle size larger than about 100 microns; and passing at least a portion of said liquid containing less than about 0.1 w % of solid particles having a particle size larger than about 100 microns as at least a portion of said cooling liquid to said contacting zone.

* * * * *